United States Patent [19]

Bayeh

[11] 4,156,392

[45] May 29, 1979

[54] COAL CONVEYING SYSTEM

[76] Inventor: Paul B. Bayeh, G-6261 N. Saginaw Rd., Mt. Morris, Mich. 48458

[21] Appl. No.: 782,724

[22] Filed: Mar. 30, 1977

[51] Int. Cl.[2] ..... F23K 3/14

[52] U.S. Cl. ..... 110/110; 34/182; 110/228; 198/658; 415/72

[58] Field of Search ..... 415/72, 73; 110/110; 34/181, 182; 198/658, 672

[56] References Cited

U.S. PATENT DOCUMENTS

| | | | |
|---|---|---|---|
| 333,939 | 1/1886 | Foote | 34/182 |
| 1,371,546 | 3/1921 | Bollmann | 34/182 |
| 1,618,338 | 2/1927 | Hoffman | 198/658 |
| 1,627,766 | 5/1927 | Bergman | 110/106 |
| 1,628,609 | 5/1927 | Newhouse | 110/106 |
| 1,658,775 | 2/1928 | Campbell | 34/182 |
| 2,392,189 | 1/1946 | Riddell | 34/182 |
| 2,441,736 | 5/1948 | Webb | 110/110 |
| 2,517,833 | 8/1950 | Bourland | 34/182 |
| 3,076,269 | 2/1963 | Hagen | 198/658 |
| 3,581,407 | 6/1971 | Ward et al. | 34/182 |
| 3,896,746 | 7/1975 | Pirsch | 110/106 |
| 3,942,455 | 3/1976 | Wallis | 110/14 |
| 4,010,552 | 3/1977 | Peterson | 34/182 |

*Primary Examiner*—C. J. Husar

*Attorney, Agent, or Firm*—Gifford, Chandler, Van Ophem, Sheridan & Sprinkle

[57] ABSTRACT

A wet coal drying apparatus is provided for use in conjunction with a coal burning furnace for drying wet coal prior to loading the coal into the furnace. The drying apparatus of the present invention comprises a first conveyor means for transporting the coal from a storage area or coal crusher to an elevated position and a wet coal dryer means for transporting the coal from the elevated position to a utility conveyor while drying the coal. The wet coal dryer means includes an enclosed type conveyor whereby the coal is transported through the interior of the enclosed dryer means. In addition, a fluid conduit feeds hot gases, preferably either a diverted portion of the exhaust gases from the furnace or, alternatively, hot air from a heat exchanger, to the lower end of the dryer means so that the hot gases pass upwardly through the interior of the dryer means. Upon doing so, the hot gases contact the coal to melt any snow mixed with the coal and thereafter dry the coal prior to and in preparation of its introduction into the furnace.

7 Claims, 3 Drawing Figures

COAL CONVEYING SYSTEM

BACKGROUND OF THE INVENTION

I. Field of the Invention

The present invention relates generally to drying systems and, more particularly, to a wet coal drying apparatus.

II. Description of the Prior Art

In coal burning furnaces of the type commonly used for the production of electrical power, the coal is typically stockpiled at a suitable storage area and transported to the furnace by any of a number of means, such as conveyor systems, trucks, and the like. However, prior to loading the coal into the furnace, the coal is pulverized which simultaneously decreases ignition time for the coal and increases burning efficiency.

One disadvantage with these previously-known arrangements is that the coal often becomes wet from rain, snow, or the like. The wet coal is difficult to ignite in the furnace and this decreases the burning efficiency of the coal. Even more seriously, after the pulverization of the coal, the granular coal tends to freeze and lump together during cold weather which makes the coal not only difficult to burn, but also tends to clog the conveyor means between the pulverizer and the furnace.

A still further problem with these previously-known coal burning furnaces is that in winter the coal is cold and wet when it is loaded into the furnace. Consequently, energy is consumed and effectively lost in the furnace due to the necessity of heating the wet and cold coal to its point of combustion or ignition temperature. This, of course, results in furnace inefficiencies.

A still further problem of the previously-known coal burning furnaces is that such furnaces lose a large amount of heat energy in their exhaust gases and in their steam condensing apparatus for a steam turbine typically used in such furnaces to generate electricity. This energy is unharnessed and thus lost to either the atmosphere or to the rivers or lakes when using water to condense the steam. Additionally, the exhaust from such coal burning furnaces is replete with particulate matter and/or soot. The soot, of course, pollutes the air so that the coal burning furnace must either include an expensive exhaust filtration system or be located away from populated areas.

SUMMARY OF THE PRESENT INVENTION

The wet coal drying apparatus of the present invention overcomes all of the above-mentioned disadvantages of the previously-known coal burning furnaces.

The wet coal drying apparatus of the present invention comprises a first conveyor for transporting the coal from a coal storage area or a coal crusher to an elevated position. The first conveyor can be of any conventional construction such as an endless belt conveyor.

A tubular housing then receives the coal from the first conveyor and transports the coal downwardly from the elevated position to a utility conveyor for subsequent pulverization, dry storage and/or introduction into the furnace. The tubular housing transports the coal through its interior and preferably a screw-type conveyor is contained within the housing.

A fluid conduit means is coupled between a hot gas source and the bottom of the interior of the tubular housing. The hot gas source may comprise either a portion of the exhaust gases from the furnace, or the output from a heat exchanger coupled to either the exhaust from the furnace or to the steam condenser from the steam turbine.

In operation, the hot gases pass through the fluid conduit and to the bottom of the housing so that the hot gases rise up through the interior of the housing and, in doing so, contact the wet and cold coal being transported through the housing. Upon such contact, the hot gases not only melts snow mixed in the coal and dries the coal in preparation for its pulverization and combustion, but in addition the coal in the housing tends to filter any particulate or soot from the hot gases passing therethrough.

The drying apparatus of the present invention thus not only increases the furnace efficiency by melting the snow mixed with the coal and drying the coal, but also increases availability by eliminating the previously-known problem of the wet pulverized coal clumping together and clogging the system. As an additional bonus, the hot gases from the furnace are filtered by the incoming coal which reduces the soot expelled to the atmosphere.

BRIEF DESCRIPTION OF THE DRAWINGS

A better understanding of the present invention will be had upon reference to the following detailed description when read in conjunction with the accompanying drawings wherein like reference characters refer to like parts throughout the several views, and in which.

DETAILED DESCRIPTION OF THE PRESENT INVENTION

Figure 1:
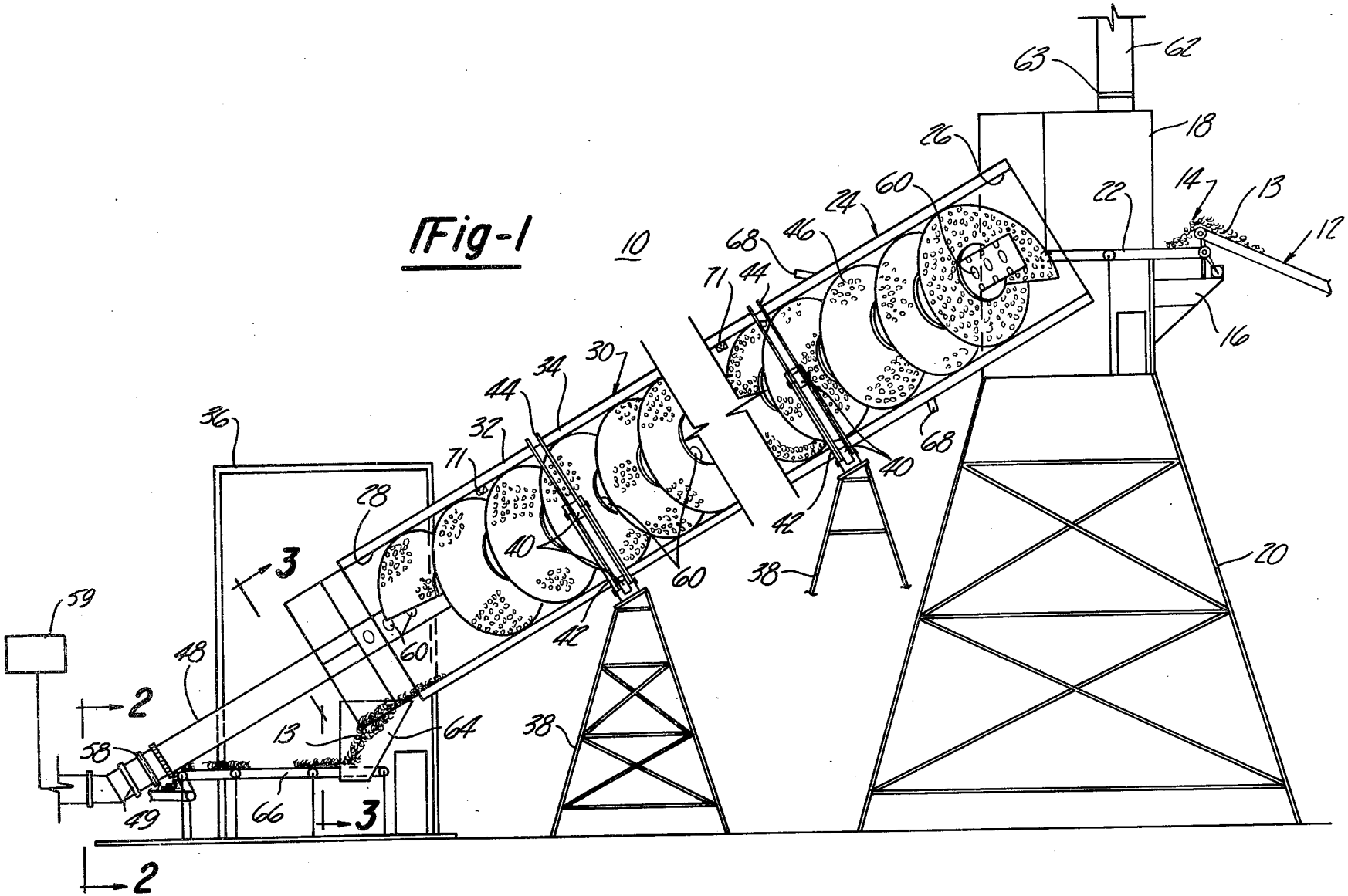
FIG. 1 is a fragmentary side plan view illustrating the wet coal drying apparatus of the present invention and with parts removed for clarity.

With reference first to FIG. 1, the wet coal drying apparatus 10 of the present invention is there shown and includes a first conveyor means 12 for transporting coal from a coal storage area or coal crusher (not shown) to an elevated position 14. The conveyor means 12 may be of any conventional construction, such as an endless belt conveyor, supported at its upper end by a projection 16 from a housing 18 which, in turn, is supported in an elevated position by a support structure 20. In addition, the first conveyor means 12 preferably includes a horizontal section 22 which transports the coal 13 into the interior of the housing 18.

A second conveyor or dryer means 24, which will be subsequently described in greater detail, receives the coal 13 from the conveyor section 22 and transports the coal 13 from the elevated position 14 at the housing 18 downwardly at an incline to a utility conveyor 66. The utility conveyor 66 transports the coal to a dry storage area and/or a coal pulverizer and the coal is subsequently loaded into the furnace.

Figure 3:
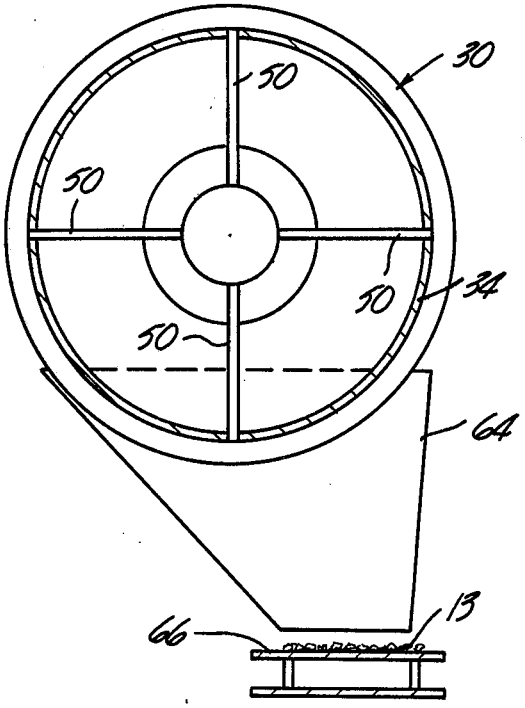
FIG. 3 is a fragmentary plan view taken substantially along line 3—3 in FIG. 1 and enlarged for clarity.

Referring to FIGS. 1 and 3, the dryer means 24 includes a tubular and cylindrical housing 30 with an outer metal covering 32 and an inner layer 34 of insulating material. The upper end or inlet 26 of the housing 30 is received within the interior of the housing 18 while the lower end or outlet 28 of the housing 30 is received within the interior of a second housing 36.

The housing 30 is supported for rotation about its longitudinal axis by means of bearing support towers 38. A plurality of rollers 40 are rotatably carried by the upper end of each tower 38 on a semicircular rail member 42. The rollers in turn are rotatably received within an annular track 44 formed around the outer periphery of the housing 30 so that the tracks 44 are parallel but axially spaced from each other. By this arangement the housing 30 can rotate along the tracks 44 about its longitudinal axis.

Figure 2:
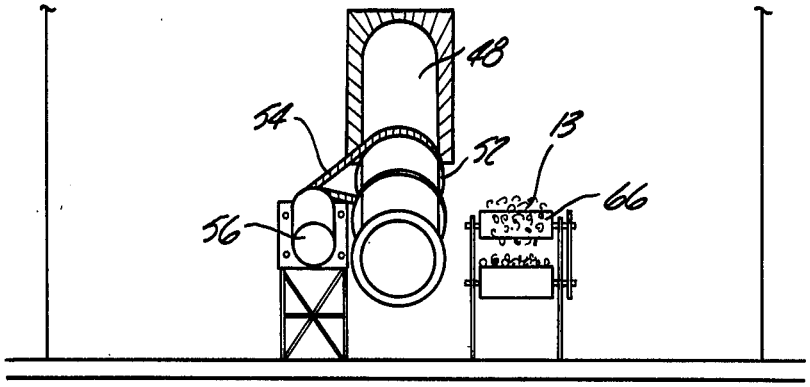
FIG. 2 is a fragmentary plan view taken substantially along line 2—2 in FIG. 1 and enlarged for clarity.

With reference now to FIGS. 1–3, a spiral conveyor or screw 46 is disposed within and carried by the housing 30 so that the outer periphery of the screw 46 abuts against the inner periphery of the housing 30. In addition, the screw 46 extends substantially from one axial end of the housing 30 to the other. An elongated tubular member 48 is disposed coaxially through the housing 30, and hence through the screw 46 along the entire length of the screw 46. The tubular member 48 is secured to both the screw 46 and the housing 30 by struts 50 (FIG. 3) so that the tubular member 48, the screw 46, and the housing 30 rotate in unison with each other. In addition, the tubular member 48 is preferably rotatably journalled in a lower bearing 49.

Although any conventional means can be used to rotatably drive the dryer means 24, preferably the tubular member 48 includes an annular gear 52 formed circumferentially about its lower end. The gear 52 is coupled by a suitable endless member, such as a chain 54, to a motor 56 so that upon actuation, the motor 56 rotatably drives the tubular member 48 and the attached screw 46 and housing 30.

The lower end of the tubular member 48 is preferably coupled by fluid conduit means 58 to the exhaust from the coal burning furnace (not shown) so that a portion of the exhaust gases from the coal burning furnace flows through the fluid conduit means 58 and up through the tubular member 48. Alternatively, of course, the conduit means 58 can be coupled to the hot gas output from heat exchanger means 59 thermally coupled with either the exhaust gas from the furnace or the steam condensing means for a steam turbine typically associated with coal furnaces for generating electricity. In addition, the tubular member 48 includes a plurality of radial ports 60 along its axial length so that the hot gases escape from the interior of the tubular member 48 and into the interior of the housing 30. The hot gases pass up through the interior of the housing 30, through the inlet 26 of the housing 30, and into the interior of the housing 18. From the interior of the housing 18, the hot gases pass through an outlet stack 62 either directly to the atmosphere or, alternatively, the exhaust stack 62 can be fluidly connected with the main exhaust stacks of the coal burning furnace. An exhaust fan 63 in the stack 62 ensures a steady hot gas flow through the housing 30.

Referring now to FIGS. 1–3, a chute 64 is provided at the bottom of the housing 30 for catching coal from the housing outlet 28 and diverting it to the utility conveyor 66, typically an endless belt conveyor. As previously mentioned, the conveyor 66 transports the coal to a dry storage area or to a pulverizer (not shown) prior to loading the coal 13 into the furnace.

The component parts of the system 10 having been described, the operation is as follows:

The coal 13, which may be both mixed with snow, wet and cold, is first transported by the first conveyor means 12 from its storage area (not shown) to the elevated position 14 at the interior of the housing 18. The section 22 of the first conveyor means 12 dumps the coal 13 into the inlet 26 of the dryer means 24.

Rotation of the second dryer means 24 by the motor 56 gradually feeds the coal 13 from the inlet 26 to the outlet 28 of the dryer means 24 and, in doing so, tends to break apart the lumps of coal which may be stuck or frozen together. It will be appreciated, however, that due to the screw 46, a predetermined approximate time span is required for the coal 13 to move from the inlet 26 of the housing 30 to its outlet 28. As previously mentioned, from the outlet 28 of the housing 30, the coal 13 is transported by the utility conveyor 66 to a pulverizer and thereafter fed into the furnace.

As the coal 13 is being transported from the inlet 26 to the outlet 28 of the dryer means 24, hot gases comprising either a portion of the exhaust gases from the coal burning furnace or the hot air output from a heat exchanger, are fed by the conduit means 58 and up through the tubular member 48. The hot gases, of course, escape through the radial ports 60 formed along the axial length of the tubular member 48 so that the hot gases pass upwardly through the interior of the conveyor housing 30. In doing so, the hot gases contact and not only melt the snow and dry the coal, but also preheat the coal 13 within the dryer means 24. The insulation layer 34 on the housing 30 also serves to retain the heat within the housing 30 while fluid drains 68 catch and channel away water (e.g., melted snow) from the coal 13.

In practice it has been found that only 5 to 10 percent of the exhaust gases from the coal burning furnace passing up through the housing 30 is sufficient to not only completely dry the coal 13 in the dryer means 24, but also to preheat the coal 13 in preparation for its pulverization and subsequent combustion. Thus, the heat energy which is normally expelled and lost through the exhaust stacks of the coal burning furnace or the heat energy which is expelled and lost in the steam condenser through cooling water is partially returned to the coal 13 in the dryer means 24 by both melting the snow, drying and preheating of the coal 13.

The dry and preheated coal 13 which is expelled from the outlet 28 of the housing 30 not only increases the burning efficiency of the furnace, but also prevents coal from freezing in the dry storage area (not shown) during cold weather. In addition, the dry coal prevents the previously-known jamming of equipment between pulverizer and furnace as has been previously caused by pulverized wet coal and thereby ensures the availability of the coal to the furnace. Moreover, as an additional advantage, the coal being transported through the dryer means 24 filters the particulate matter or soot from the hot gases passing therethrough so that the exhaust gases emitting from the inlet 26 of the housing 30 are relatively pollution free. Consequently, if desired, the exhaust gases exiting from the upper end of the housing 30 can be exhausted directly to the atmosphere without further filtration.

From the foregoing it can be seen that the wet coal drying apparatus 10 of the present invention provides a simple and yet highly effective means for melting snow and drying and preheating coal prior to its pulverization and injection into a coal burning furnace. Moreover, the system 10 of the present invention utilizes either the exhaust gases from the coal burning furnace or hot air from heat exchangers coupled to either the furnace exhaust gases or steam condenser in a steam generator as its main energy source. The present invention thus harnesses energy which would otherwise be wastefully expelled to the atmosphere or environment thereby conserving energy.

Further improvements are, of course, possible to the drying apparatus 10 of the present invention. For example, water nozzles 71 could be disposed within the housing 30 and automatically activated by means not shown to cool the dryer means 24 when the temperature within the housing 30 exceeds a predetermined amount. Similarly, the drying means 24 could also encompass the utility conveyor 66 to further heat and dry the coal as it is transported from the housing 30 to the pulverizer.

Having thus described my invention, many modifications thereto will become apparent to those skilled in the art to which it pertains without deviation from the spirit of the invention as defined by the scope of the appended claims.

I claim:

1. For use in conjunction with a coal burning furnace which produces heated exhaust gases upon combustion of the coal, an apparatus for moving coal from a coal storage area to said furnace comprising:

conveyor means for transporting coal from said storage area to an elevated position;

coal drying means having a tubular and cylindrical housing with a hollow interior for transporting coal downwardly through the interior of said housing in a first axial direction from said elevated position to said furnace for its combination, said coal drying means including a spiral member extending through the interior and substantially along the entire axial length of said housing, said spiral member being secured to said housing;

means for rotating said spiral member; and fluid conduit means for communicating hot gases produced by the combustion of the coal in the furnace from said furnace through the interior of said housing in an axial direction opposite from said first axial direction whereby said hot gases contact and both heat and dry the coal being transported through said housing, said fluid conduit means comprising a tube extending coaxially through the interior of said housing and being secured to said spiral member for rotation therewith, said tube having a plurality of radial ports formed along its length and within the interior of said housing to expel said hot gases from the interior of said tube and into the interior of said housing.

2. The invention as defined in claim 1 and including a layer of insulating material secured to and around said housing.

3. The invention as defined in claim 1 and further comprising:

annular track means formed around the outer periphery of said housing; and bearing means for rotatably engaging and supporting said track means.

4. The invention as defined in claim 1 wherein said fluid conduit means communicates 5 to 10 percent of the total exhaust gases from said furnace to the interior of said drying means.

5. The invention as defined in claim 1 and including fluid drain ports formed through said housing for draining water away from the interior of said housing.

6. The invention as defined in claim 1 wherein said fluid conduit means is coupled to a heat exchanger thermally coupled with the exhaust gases from said furnace.

7. The invention as defined in claim 1 and including a steam generator having a condenser and associated with said furnace, and wherein said fluid conduit means is coupled to a heat exchanger thermally coupled with said condenser.

* * * * *